US005121505A

United States Patent [19]

Ludmer et al.

[11] Patent Number: 5,121,505

[45] Date of Patent: Jun. 16, 1992

[54] TOURIST MAP CONSTRUCTION IN COMBINATION WITH AN ARTICLE OF CLOTHING

[75] Inventors: Michael Ludmer, 17420 Ventura Blvd., Encino, Calif. 91316-3846; Robert M. Ashen, Beverly Hills, Calif.

[73] Assignee: Michael Ludmer, Encino, Calif.

[21] Appl. No.: 614,147

[22] Filed: Nov. 15, 1990

[51] Int. Cl.[5] ..... A41B 1/00

[52] U.S. Cl. ..... 2/94; 2/113; 2/115; 2/82; 40/586

[58] Field of Search ..... 2/94, 113, 115, 82; 434/395, 130, 154, 133, 134; 40/586; 283/34, 35, 36, 37

[56] References Cited

U.S. PATENT DOCUMENTS

| | | | |
|---|---|---|---|
| 4,354,282 | 10/1982 | Langdon | 2/115 |
| 4,365,353 | 12/1982 | Rayl | 2/115 |
| 4,625,337 | 12/1986 | Zahn | 2/82 |
| 4,710,981 | 12/1987 | Sanchez | 2/115 |
| 4,847,916 | 7/1989 | Winston | 2/115 |

*Primary Examiner*—Werner H. Schroeder
*Assistant Examiner*—Gloria Hale
*Attorney, Agent, or Firm*—Ashen & Lippman

[57] ABSTRACT

A map construction for use by a tourist at a new site or location such as an amusement park or a college campus. The illustrated construction is in the form of a shirt having a front panel with an outwardly facing surface. The surface is provided with a map of the area in question. The map is oriented (i) with the bottom of the map uppermost and the top of the map lowermost, and (ii) with the map low enough, to facilitate ready reading and use of the map by the person wearing the shirt and without having to remove the shirt. The user wearing the shirt simply looks down and sees the map of the desired area in an orientation where it can be read by the wearer. In one form, a map may be provided on the outer surface of the rear panel of the shirt for use by a companion of the person wearing the shirt. The map on the rear panel is oriented with the top of the map uppermost. Indications may be provided that the user can selectively affix to the map to indicate the user's current location, desired destination, or the like.

10 Claims, 1 Drawing Sheet

TOURIST MAP CONSTRUCTION IN COMBINATION WITH AN ARTICLE OF CLOTHING

BACKGROUND OF THE INVENTION

Contemporary shirts have become more than just a covering for the upper part of the body. They have been used to display a wide variety of graphic and textural material. It has become common for people to acquire a shirt in connection with a trip or a visit to a particular local such as a museum, a zoo, a college campus or an amusement park. Some locations such as parks, college campuses and the like have gotten to be large and complex, making it often difficult for visitors to find their way around if they are not familiar with the location. Thus, maps are often prepared and provided for such visitors to help them find their way around. Traditional maps are folded large pieces of paper that have several disadvantages for a visitor to such a location. The map is a separate article that must be kept track of and is prone to being lost, especially by younger visitors. To be convenient to carry around, the maps normally fold into a small size that can fit into a pocket or a purse. When the map is needed, however, it has to be taken out of the pocket or purse and unfolded and held in its extended enlarged condition to permit its proper use. This can be difficult and inconvenient if the visitor is carrying cameras, young children, purchases from the gift shop, etc., etc.

The present invention contemplates an elegant solution to the foregoing limitations to the normal folded paper map. A map of the area as provided on the forward face of the front panel of an article such as a shirt that can be worn by the visitor. The map is oriented (i) with its bottom uppermost and (ii) sufficiently low on the shirt, so that the wearer/visitor can easily look down and directly utilize the fully extended map whenever such is desired. There is no need to fold and unfold and put away and take out the map. It is always out and ready for use. Such a shirt also provides an attractive and desirable souvenir for the visitor to take back home from the trip. The visitor also saves the cost of buying an extra map for one-time use. The shirt with the map on it continues to act as a useful article as well as a memento of the trip for future use by the visitor. Instead of a shirt, the article might be a bib or an apron or the like.

To facilitate use of the map, indicators may be provided for securing to the map at selected locations to indicate where the wearer is currently located, one or more desired destinations, or the like. These indicators will draw the user's attention back to desired locations on the map without requiring "starting over" to get reoriented each time the map is consulted.

SUMMARY OF THE DISCLOSURE

In a simple form, the forward face of the front panel of a tourist shirt is provided with a map of the particular desired locale. The map is oriented (i) with the bottom of the map uppermost, and (ii) with the map low enough so that, when the shirt is worn by a visitor/user, the user can simply look down and read the map. The map is always extended and ready for use and in the proper orientation so that the hands of the user need not be utilized but can be occupied with other activities such as holding children, souvenirs, balloons, wallets, purses, etc. In one form the shirt may have a second map on the back panel facing rearwardly, but oriented with top of the map upwardly. This map may be used by other members of the visitor's party to assist in navigating the area. Indicators such as stick-on tabs may be provided; the indicators can be selectively positioned on the map to show significant locations such as the wearer's current location and/or the route to desired destinations. The tabs may be of the removable stick-on type; this will allow the user to periodically update his or her current location or the like.

IN THE DRAWINGS

DETAILED DESCRIPTION OF THE DRAWINGS

Figure 1:
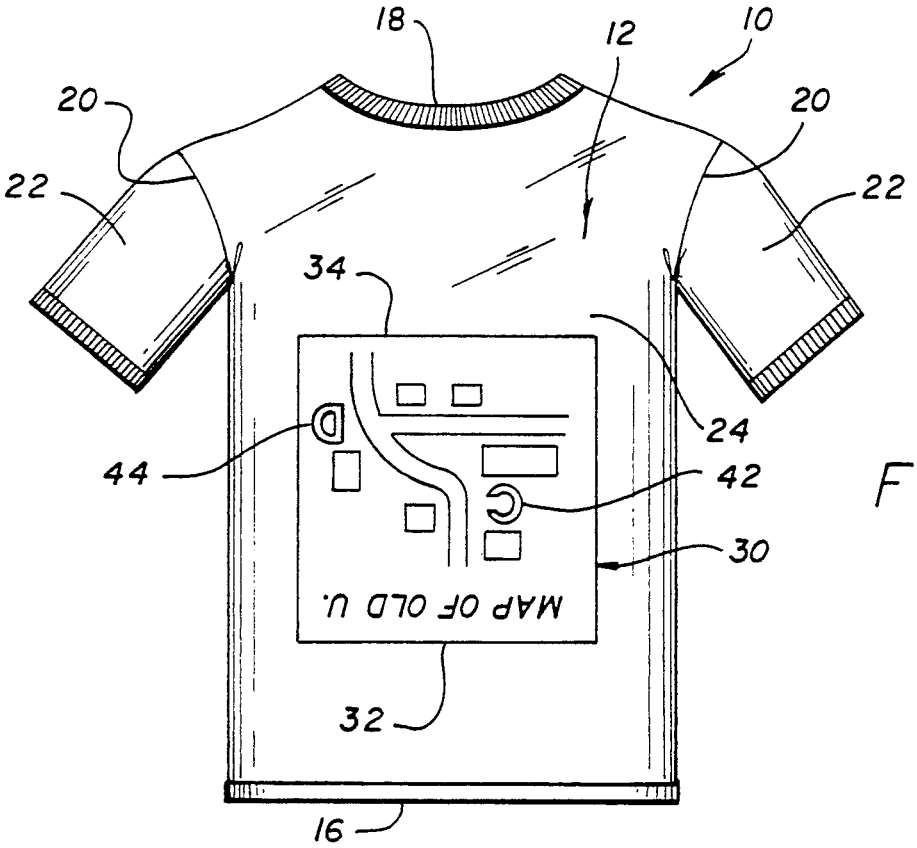
FIG. 1 is a front plan view of a shirt comprising a presently preferred embodiment of the invention.

FIG. 1 shows a presently preferred embodiment of the invention in the form of a t-shirt 10 having front and back body panels 12, 12*b* that define an open bottom 16, an upper neck opening 18 and a pair of opposed arm openings 20 to which sleeves 22 may be attached. The illustrated shirt shows sleeves as being short sleeves. The front panel 12 of the shirt as shown in FIG. 1 has a forward surface 24 on which a map 30 is provided. The map 30 may be of any desired locale such as a college campus, a zoo, an amusement park or the like. The map 30 is oriented with the upper end 32 of the map 34 lowermost on the shirt and the lower end of the map uppermost. The map 30 is also low enough on the shirt so that the wearer can look down and see essentially all portions of the map (including the bottom portion which is uppermost on the shirt). This orients the map so that when the shirt is being worn the user can simply look down and view the fully extended map. The user does not have to take off the shirt or manipulate it in any particular way. It is not required that the map be folded and unfolded for use or for transport. If desired, the lower portion of the front panel of the shirt may be manually pulled forward and away from the wearer to generally tilt that front panel and make it easier to read for the wearer.

Figure 2:
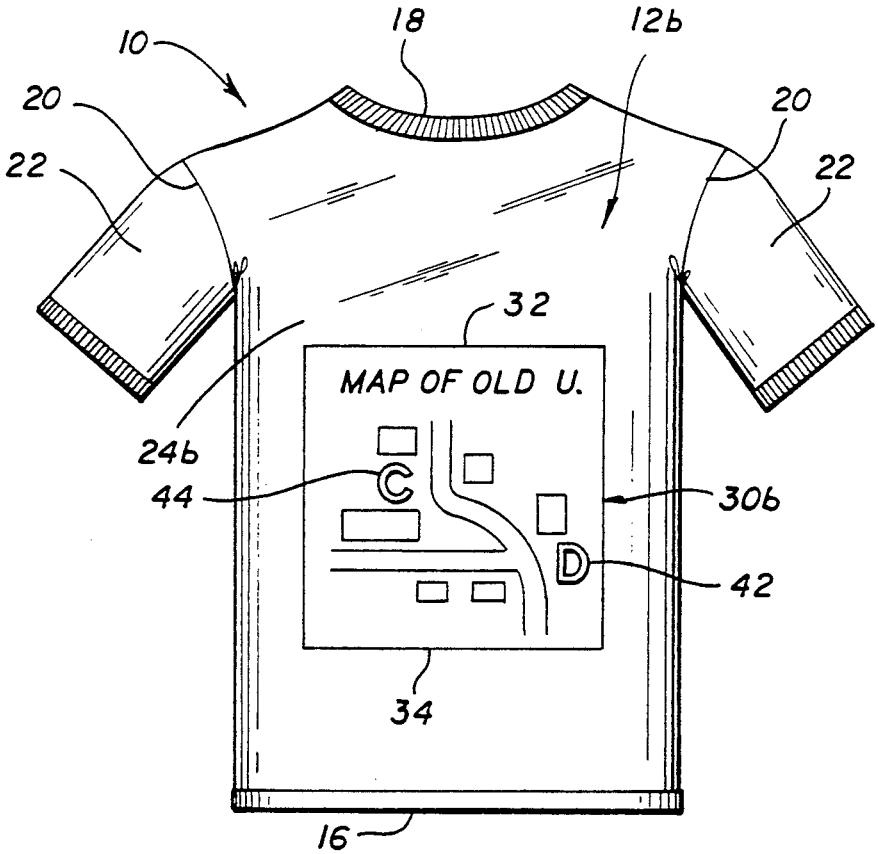
FIG. 2 is a back plan view of the shirt of FIG. 1.

If desired, a second like map 30*b* may be provided on the surface 24*b* of the rear panel 12*b* of the shirt 10 as shown in FIG. 2. This map 30*b* would be in upright orientation and could be used by people in the wearer's party other than the wearer. The map may be applied in any of a variety of ways, such as being screen printed directly onto the material of the shirt panel, or it may be on a separate panel which is secured to the shirt front as by adhesive or stitching or other suitable means. The shirt map may be colored or black-and-white as desired. The article bearing the map or maps can take alternative forms such as an apron, a bib, a vest closing in the rear, etc.

Indicator or locator means 40 may be provided to attach to the shirt at selected locations on the maps. These locator means 40 could be variously colored and/or shaped markers of the stick-on type. Each marker can be made of a shaped piece of paper or plastic sheet material having an adhesive on its rear surface. For example, a red indicator 42 in the shape of a "C" could be used to show on the map the current location of the wearer, and a yellow indicator 44 in the shape of a "D" could be used to show on the map the desired destination of the wearer. The markers could also be shaped as circles, triangles, animal figures, etc. In one form the markers may releasibly attach to the map; the adhesive would be of a reusable type. An edge portion of the marker could be without adhesive to provide a handle to grasp and relocate the marker. As the wearer progresses on his or her route, the current location indicator can be repositioned to show the new current location. Alternatively, the indicators could be permanently affixed and new ones simply added as is desired.

The details of construction may be modified or changed without departing from the spirit and the scope of the invention as set forth in the following claims:

What is claimed is:

1. A tourist map of a geographical area bounded by a lowermost end and an uppermost end, in combination with an article for being worn on the upper body of a user, said article having a first panel with a surface facing forwardly of the user when the article is worn by the user, said surface having said map imprinted thereon, the map being oriented (i) with its upperend lowermost and its lowerend uppermost and (ii) sufficiently low on the front panel so that the map is directly and readily viewed in its substantial entirety by the user when the user is looking downwardly.

2. The article of claim 1 wherein said article also has a second panel with a second surface facing rearwardly of the user when the article is worn by the user, said second surface having a similar map of the area, said second map being oriented with its upper end upwardmost and its lower end lowermost for use by companions of the wearer of the article.

3. The construction of claim 1 further comprising at least one locator means attachable to the first panel so as to designate a selected location of the map.

4. The construction of claim 3 comprising at least two locator means, one to indicate on the map a current location of the wearer and one to indicate on the map a desired destination of the wearer.

5. The construction of claim 4 wherein said at least two locator means are at least two different colors.

6. The construction of claim 4 wherein said at least two locator means are at least two different shapes.

7. The construction of claim 3 wherein said locator means is releasibly attachable to permit its ready relocation to other locations on the map.

8. The construction of claim 3 wherein said locator means comprises a section of sheet material having an adhesive on the rear surface thereof.

9. A tourist map of a geographical area bounded by a lowermost end and an uppermost end in combination with an article for being worn on the upperbody of a user, said article having a first panel with a surface facing forwardly of the user when the article is worn by the user, said surface having said map imprinted thereon, a plurality of locator means for being releasibly attached to selected positions on the map, at least one locator means to mark the location on the map that the user occupies and at least one other locator means to mark a location on the map to which the user desires to travel.

10. The construction of claim 9 wherein said locator means are each a piece of sheet material having a reusable adhesive on the rear surface thereof.

* * * * *